US007011089B2

(12) United States Patent
Tokatlian

(10) Patent No.: US 7,011,089 B2
(45) Date of Patent: Mar. 14, 2006

(54) SUB-AQUA BREATHING SYSTEM

(76) Inventor: Sarkis Tokatlian, The Garden Flat, 58 Holland Road, Greater London W14 8BB (GB)

( * ) Notice: Subject to any disclaimer, the term of this patent is extended or adjusted under 35 U.S.C. 154(b) by 0 days.

(21) Appl. No.: 10/715,115

(22) Filed: Nov. 18, 2003

(65) Prior Publication Data

US 2004/0163642 A1 Aug. 26, 2004

Related U.S. Application Data

(63) Continuation of application No. PCT/GB02/02271, filed on May 15, 2002.

(30) Foreign Application Priority Data

May 18, 2001 (GB) ..... 0112244

(51) Int. Cl.
*B63C 11/02* (2006.01)

(52) U.S. Cl. ..... 128/201.27; 128/201.28; 128/204.26

(58) Field of Classification Search ..... 128/201.11, 128/201.27, 201.28, 204.26, 205.21, 205.22
See application file for complete search history.

(56) References Cited

U.S. PATENT DOCUMENTS 329,391 A * 10/1885 Huntley ..... 128/201.19
813,431 A * 2/1906 Iwanami et al. ..... 128/201.27
835,950 A * 11/1906 Iwanami ..... 128/201.11
1,331,819 A * 2/1920 Matheny ..... 440/62
1,608,264 A * 11/1926 Figlietti ..... 128/201.22
2,593,988 A * 4/1952 Cousteau ..... 128/201.27
2,844,145 A * 7/1958 Berge ..... 128/205.22
3,705,697 A * 12/1972 Chagnon ..... 242/404.1
3,907,236 A * 9/1975 Sims, Jr. ..... 242/404.1
4,022,201 A * 5/1977 Diggs ..... 128/201.11
4,238,864 A * 12/1980 Kealoha ..... 441/25
4,245,632 A * 1/1981 Houston ..... 128/205.13
4,324,195 A * 4/1982 Cunningham et al. ..... 114/312
4,674,493 A * 6/1987 Mitchell ..... 128/202.14
4,756,486 A * 7/1988 Campbell ..... 242/396.9
4,832,013 A * 5/1989 Hartdorn ..... 128/202.14
4,986,267 A * 1/1991 Doss ..... 128/201.27
5,067,920 A * 11/1991 Brisky ..... 441/25
5,173,067 A * 12/1992 Biba ..... 441/25
5,193,530 A * 3/1993 Gamow et al. ..... 128/201.27
5,327,849 A * 7/1994 Miller ..... 114/315
5,351,681 A * 10/1994 Hudson ..... 128/201.11
5,373,925 A * 12/1994 Handford et al. ..... 191/12.2 A
5,392,808 A * 2/1995 Pierce ..... 137/355.23

(Continued)

FOREIGN PATENT DOCUMENTS

EP 0 341 085 11/1989

(Continued)

*Primary Examiner*—Aaron J. Lewis
(74) *Attorney, Agent, or Firm*—Venable LLP; Robert Kinberg; Thomas G. Wiseman

(57) ABSTRACT

A sub-aqua breathing system which enables a person operating underwater to breathe air from a compressed air tank supported on the water surface. The system includes a housing containing both a buoyant material and a toroidal compressed air tank connected to an air line feeding a conventional mouthpiece regulator. The air line may be coiled and stored within, or on, the housing. Preferably the housing is of discus-like shape with the buoyant material in the form of floats normally nested within the housing, but deployable radially outward to increase stability when the assembly is floating on the water surface.

17 Claims, 9 Drawing Sheets

U.S. PATENT DOCUMENTS

| | | | | | |
|---|---|---|---|---|---|
| 5,471,976 | A | * | 12/1995 | Smith | 128/201.27 |
| 5,535,734 | A | * | 7/1996 | Lu et al. | 128/201.27 |
| 5,697,572 | A | * | 12/1997 | Salentine et al. | 242/379 |
| 5,924,416 | A | * | 7/1999 | Miller | 128/201.27 |
| 5,938,140 | A | * | 8/1999 | Fundak | 242/396.2 |
| 5,996,578 | A | * | 12/1999 | MacGregor | 128/204.26 |

FOREIGN PATENT DOCUMENTS

| | | | | |
|---|---|---|---|---|
| EP | 0 341 085 | A1 | | 11/1989 |
| EP | 0 341 085 | B1 | * | 8/1993 |
| WO | WO 97/10991 | | * | 3/1997 |
| WO | WO 97/12175 | A1 | | 4/1997 |

* cited by examiner

SUB-AQUA BREATHING SYSTEM

CROSS-REFERENCE TO RELATED APPLICATION

This is a continuation of International Patent Application No. PCT/GB02/02271 filed May 15, 2002, designating the United States and claiming priority of British Patent Application No. 0112244.9 filed May 18, 2001, the disclosures of both foregoing applications being incorporated herein by reference.

BACKGROUND OF THE INVENTION

The present invention relates to a sub-aqua breathing system that allows a person operating underwater to breathe air from a compressed air tank supported on the water surface.

There are many occasions when it is desired to operate below the water surface, for example when freeing the propellers of water craft entangled with fishing nets, lines, or weed, etc. in rivers or streams; for the inspection of vessel hulls; for the rescue of people trapped below the water surface in swimming pools, or from cars or vessels sunk in rivers or docks; or for sporting purposes.

Normally sub-aqua or 'SCUBA' equipment can be used in such situations but it is heavy and cumbersome to operate and difficult to manoeuvre whilst wearing. 'SCUBA' equipment also takes some time to get ready for use and/or put on and this can be a serious problem in, for example, an emergency situation.

Recently there have been developments in which floating members, similar to large life buoys or rubber dinghies, are used to support a petrol engine or, batteries and an electric motor, which drive an air pump to feed a hose, possibly via an air receiver, with a mouthpiece regulator at the remote end of the hose. Such devices are cumbersome, heavy to transport, difficult to maintain and are expensive.

SUMMARY OF THE INVENTION

The present invention seeks to provide a sub-aqua breathing system that overcomes or substantially alleviates the drawbacks of the prior art described above and other known deficiencies of existing underwater breathing equipment.

According to the present invention, there is provided a sub-aqua breathing system comprising a housing containing buoyant material and a toroidal compressed air tank, said tank being connectable to an air line feeding a mouthpiece regulator.

Preferably, the buoyant material is disposed in regions around the periphery of the toroidal compressed air tank.

The housing conveniently includes a storage compartment for an air-line when not in use.

In a preferred embodiment, the system includes a base rotatably mounted to the housing to cover the storage compartment and having at least one opening therein for the passage of an air-line from the storage compartment through the base.

In an alternative embodiment, the sub-aqua breathing system including a base and a release mechanism for releasably mounting the base to the housing over the storage compartment.

Preferably, the release mechanism is a lever pivotally mounted to the housing, the lever and base including cooperating means that engage to retain the base on the housing.

The release mechanism advantageously includes spring means to bias the lever into a position in which the cooperating means are in engagement.

Preferably, the release mechanism includes a safety release pin that cooperates with the housing and the lever to prevent inadvertent operation of the release mechanism.

In a preferred embodiment, the sub-aqua breathing system includes at least one air line coiled within the storage compartment, the or each air line having one end connected, via an air flow control valve, to the toroidal compressed air tank.

Preferably, a removable cover is mounted on the housing to provide access to the interior thereof.

The housing may conveniently contain a mast with a diving pennant attached thereto, the mast being removable from the housing and mountable in a socket thereon.

In one embodiment, the buoyant material is formed from a number of circumferentially spaced floats the system including means for radially deploying the floats from the housing.

Preferably, the deployment means includes an air bag associated with each float and inflatable in response to operation of a manually operated valve to direct air from the compressed air tank to the air bags to radially deploy the air bags from the housing.

The floats are advantageously attached to spring means operable to retract the floats in response to operation of a second manually operated valve to expel the air from the air bags.

The housing preferably has a discus-like shape.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
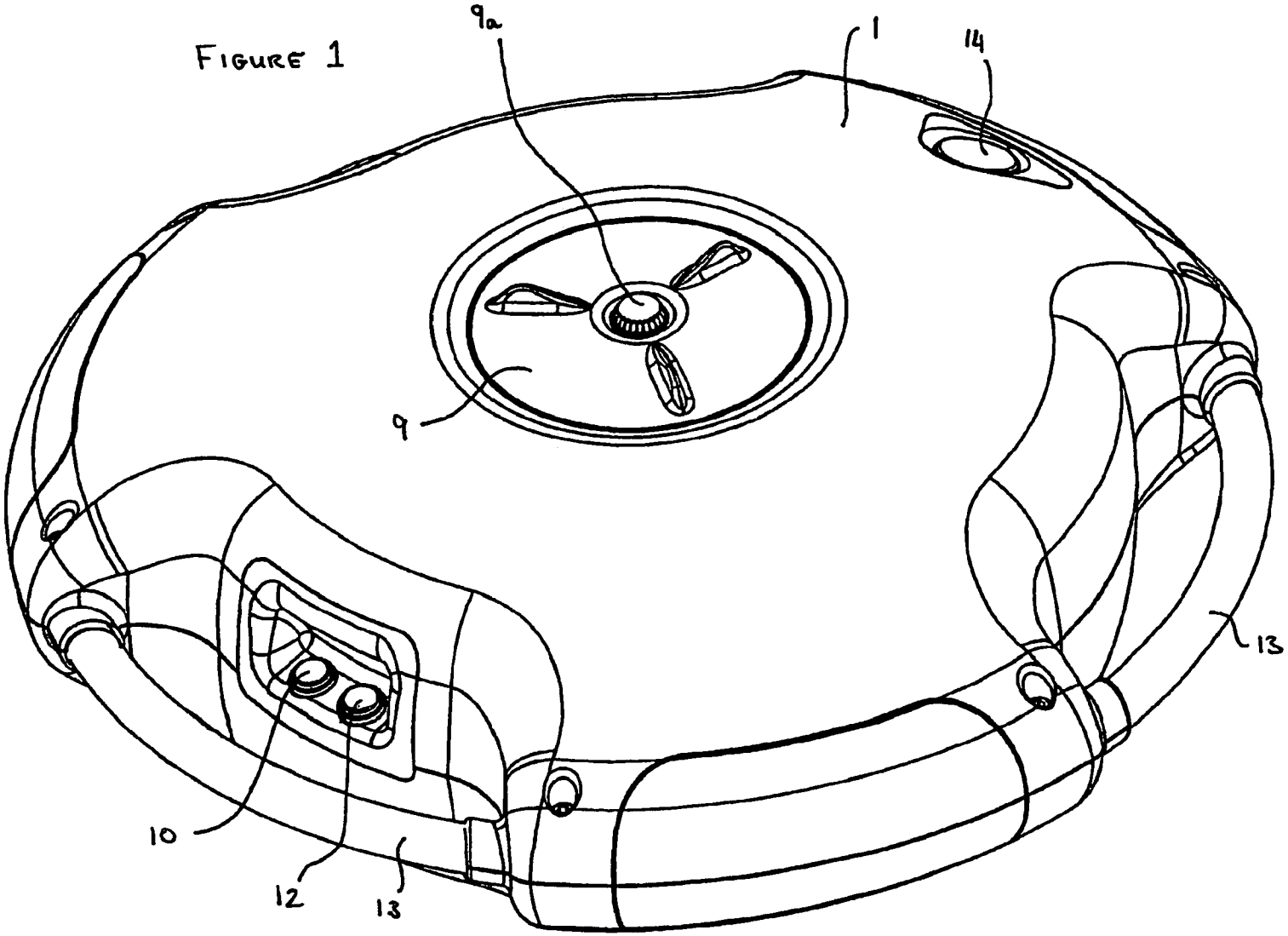
FIG. 1 shows a top perspective view of a sub-aqua breathing system according to an embodiment of the invention.
Figure 2:
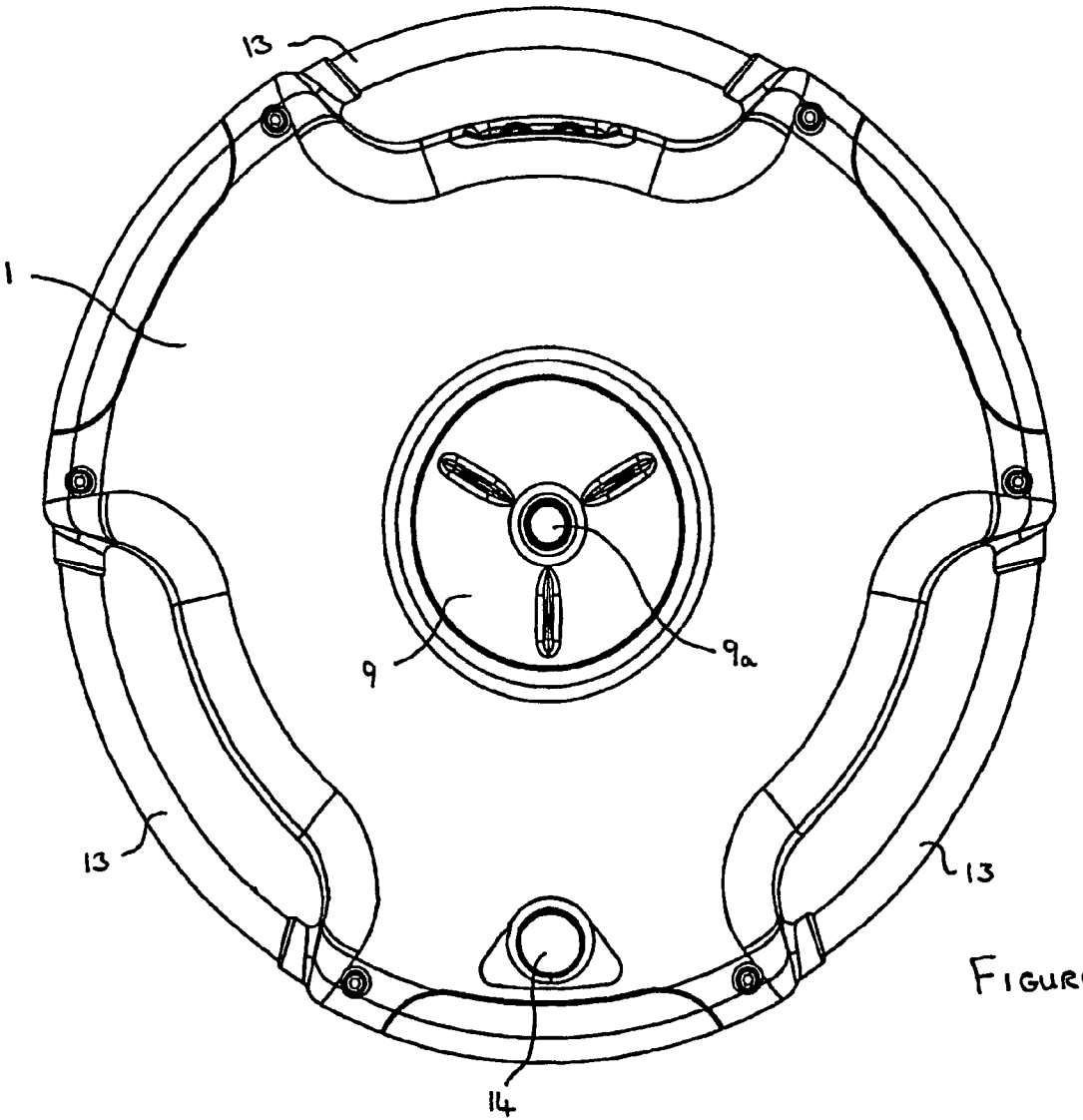
FIG. 2 shows a top plan view of the system illustrated in FIG. 1.
Figure 3:
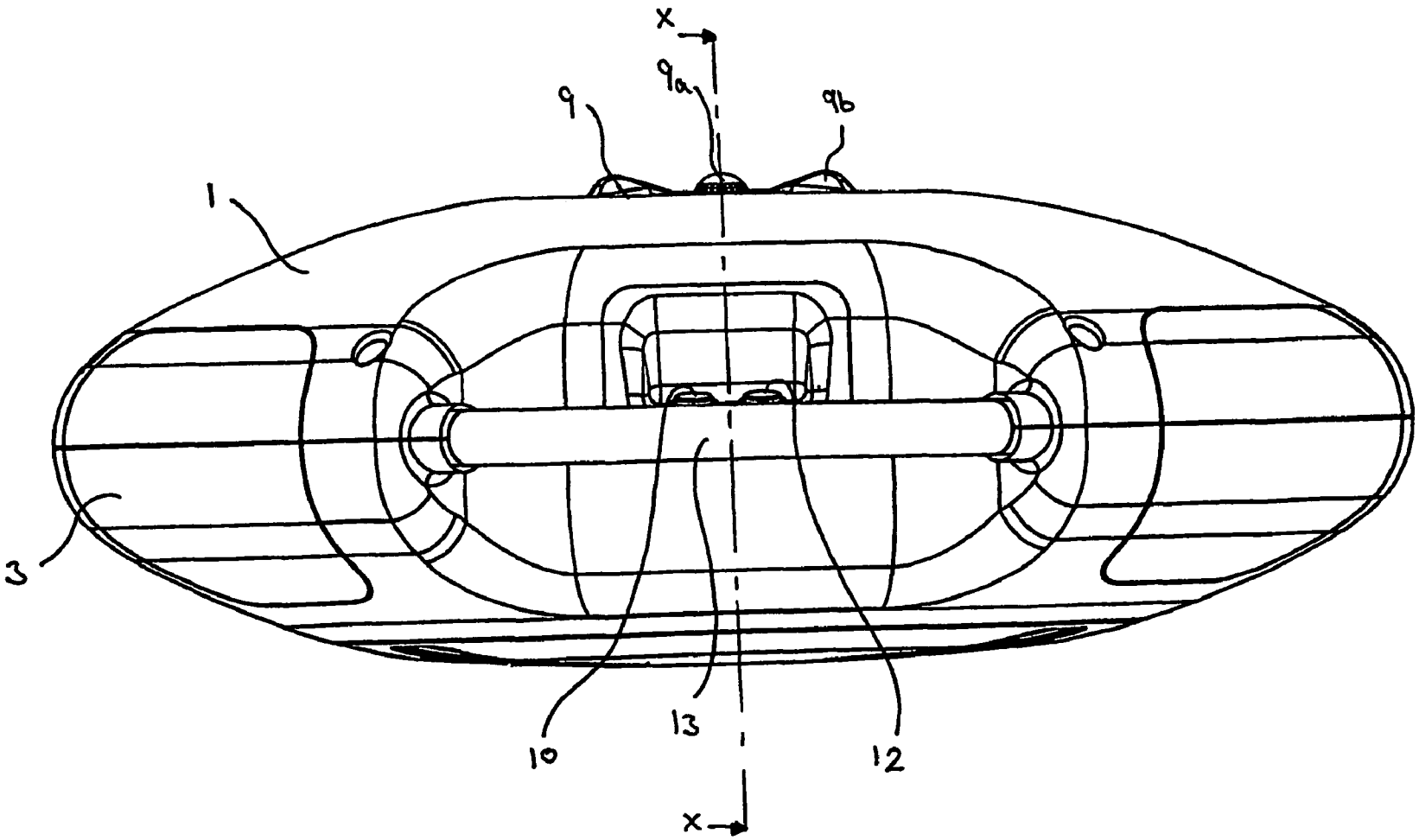
FIG. 3 shows a front view of the system illustrated in FIG. 1.
Figure 4:
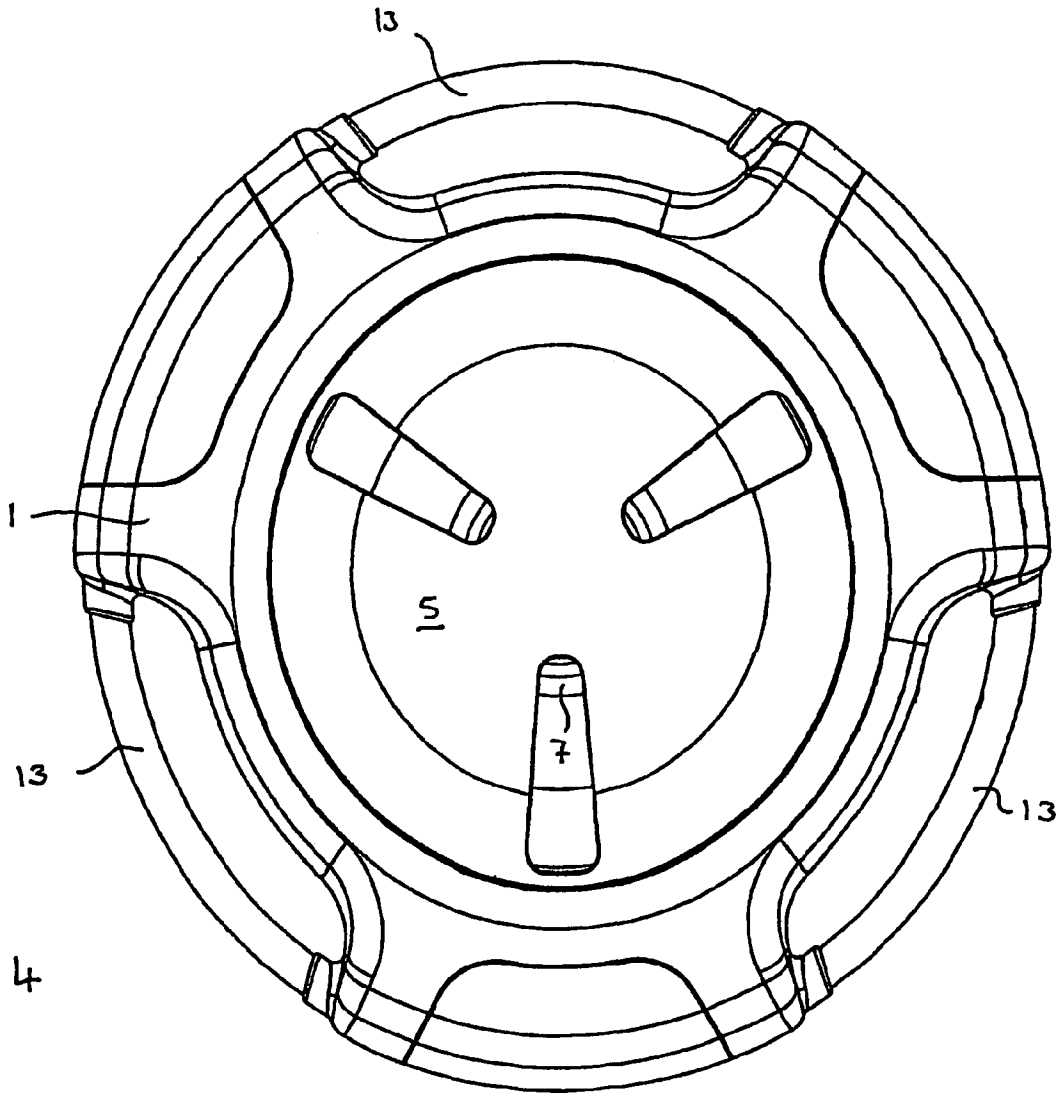
FIG. 4 shows a bottom plan view of the system illustrated in FIG. 1.
Figure 5:
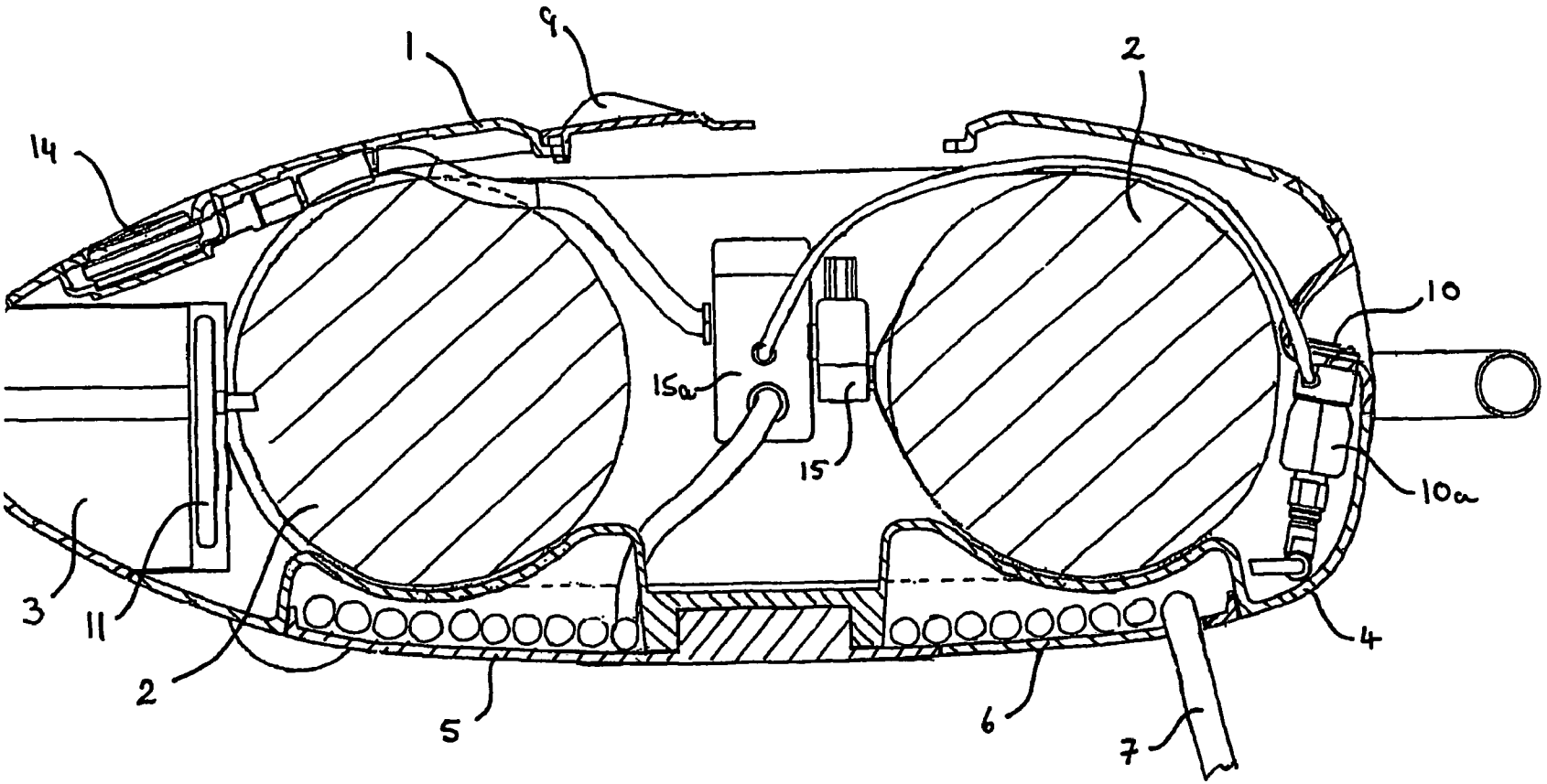
FIG. 5 shows a cross sectional view along line X—X in FIG. 3.

With reference to the drawings, the equipment comprises a two-part, lightweight plastics, injection moulded generally circular housing 1 enclosing a toroidal compressed air tank 2. The housing also contains regions of buoyant material 3 surrounding the tank 2. The bottom part 4 of the housing has a central disc-like rotatable portion 5 with apertures 6 through one of which the air line 7 extends, the air line being coiled inside the housing 1 and fed out, or wound up inside the housing 1, by rotation of the central rotating portion 5 in opposite directions respectively. The air line 7 may be 10 metres long, and can be extended by the addition of one or two additional 10 meter lengths. The present embodiment (see FIG. 5) is shown with only one air line 7 coiled up and extending from the housing 1. However, it will be appreciated that the housing 1 may also contain multiple air lines 7 coiled up within it.

The top part 8 of the housing has a removable central portion 9 through which access to the interior of the housing 1 may be obtained and which contains the main compressed air control valve 15 and first stage regulator 15*a* which reduces the pressure from the tank to an intermediate pressure which is supplied via the air line to a mouthpiece or second stage regulator (not shown) which reduces the intermediate pressure to ambient water pressure and which supplies air when the user inhales. The interior of the housing 1 may also be used to store a telescopic mast carrying the conventional 'diver working below' pennant (not shown). The mast can be removed from the interior of the housing 1 and engaged in a socket (not shown) in the top of the housing 1 or in the removable central portion 9 so that it extends vertically upwardly from the housing 1. The central portion 9 also carries a light 9*a* that may be controlled so that it illuminates or flashes when the assembly is in use. The light may also be used to summon assistance by flashing, in morse code, the universal SOS signal.

The top and bottom parts of the housing 8,4 are attached to each other and together form a sealed unitary component. Similarly, an "0" ring is disposed between the cover 9 and the housing 1 so that the cover 9 forms an airtight fit with the housing 1 when the cover 9 is in place. The cover 9 and housing 1 cooperate with each other with a bayonet type fitting. Nodules 9*b* are formed on the upper surface of the cover 9 to enable the user to manipulate the cover 9 and attach it or remove it from the housing 1. The air trapped inside the airtight housing 1 provides additional buoyancy to that provided by the buoyant material.

Figure 6:
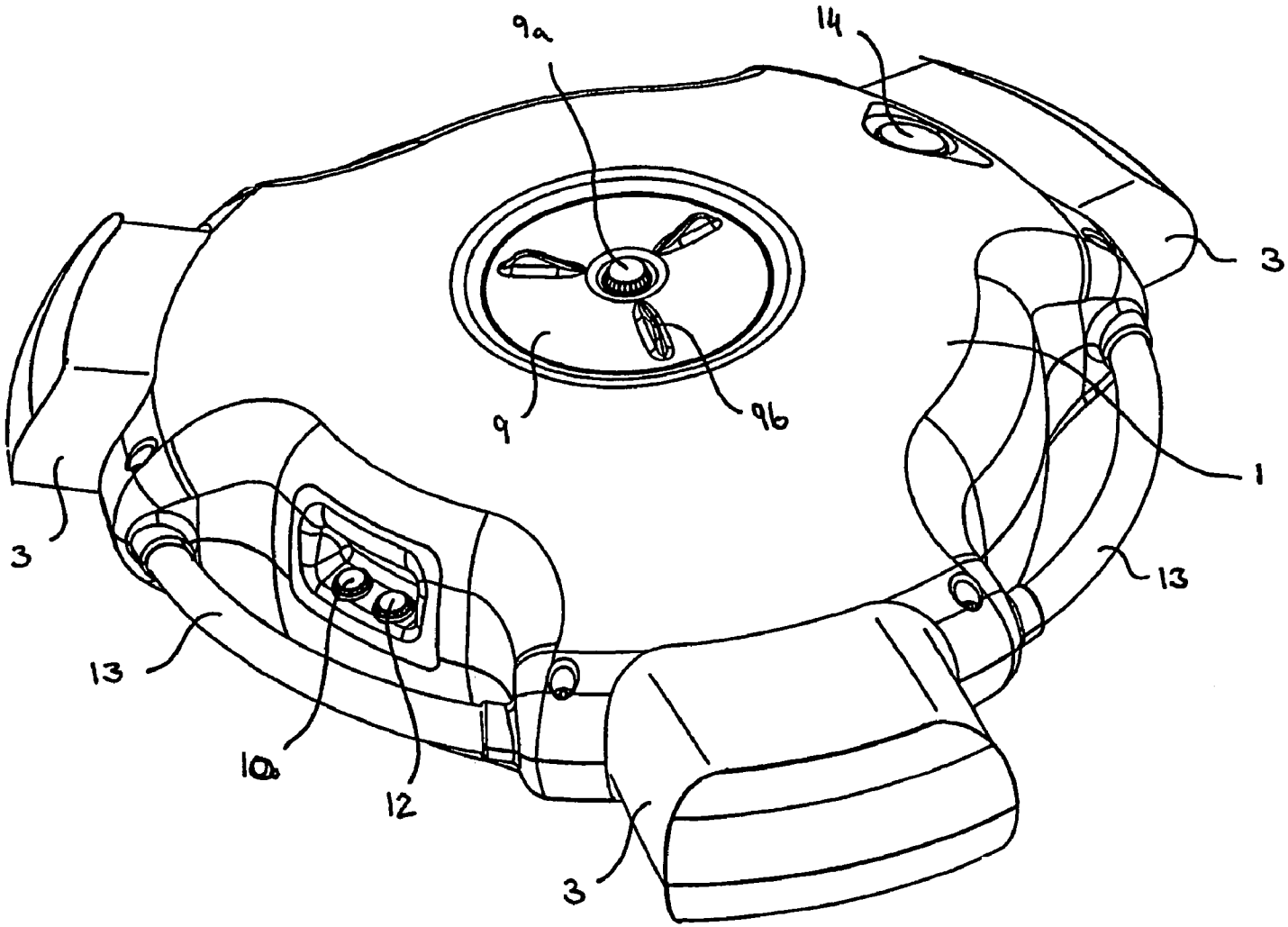
FIG. 6 shows a top perspective view of the system illustrated in FIG. 1 but with the floats in their extended positions.

The buoyant material may be a single body within the housing outside the toroidal air tank 2, or a number of separate floats 3 equally spaced about the periphery of the toroidal tank 2 and having their radially outer surface contiguous with and forming, or being attached to a separate section of the outer surface of the housing 1. The separate floats 3 are mounted so that they move radially outwardly when a valve 10*a*, controlled by a button 10 operable from outside the housing 1, feeds air from the tank 2 to inflate air bags 11 mounted between the float 3 and the air tank 2 to provide additional buoyancy and support on the water surface especially in rough seas or bad weather, as shown in FIG. 6. The floats 3 are retractable by suitable springs (not shown) when a second button 12 is pressed to cause dumping of the air in the bags 11 via a second valve (not shown). In an alternative, simpler version of the system, the floats 3 may be fixed and immovable within the housing 1.

The housing 1 has circumferentially spaced regions around its periphery that are cut away. Handles 13 extend across these regions e.g. between the extensible floats, to allow easy carrying of the assembly, and to provide support for the user when they surface.

The device can be supplied with suitable air line systems to support 2 or 3 users for specific purposes, such as for SCUBA training purposes to allow trainees to become accustomed to breathing underwater without suffering the encumbrance of the air supply tank, or for sub-surface rescue where one mouthpiece regulator may be replaced by a regulator connected to an "orinasal" (breathing mask) for use by the person being rescued. The air tank 2 may be filled with sufficient compressed air to provide air for a single diver for about 2 hours before recharging is required. However, it will be appreciated that when multiple or branched air lines 7 are used to support multiple users the air supply will be expended more quickly. A pressure gauge 14 is mounted on the housing 1 to provide a visible indication of the air pressure in the tank 2.

An alternative embodiment of the device will now be described with reference to FIG. 7 to of the accompanying drawings. The assembly is the same as that described with reference to the first embodiment with the exception that the air line or lines 7 are deployed from the housing 1 in a different fashion. Instead of being rotatable, the portion 5 is releasable from the housing 1 and drops away from it in response to operation of a release mechanism 20 so that the coils of the air line are quickly and completely freed from the housing 1. This version is more appropriate when the assembly is to be used as an emergency life saving aid as the air line 7 is released very quickly and does not need to be unwound from the housing 1.

Figure 7:
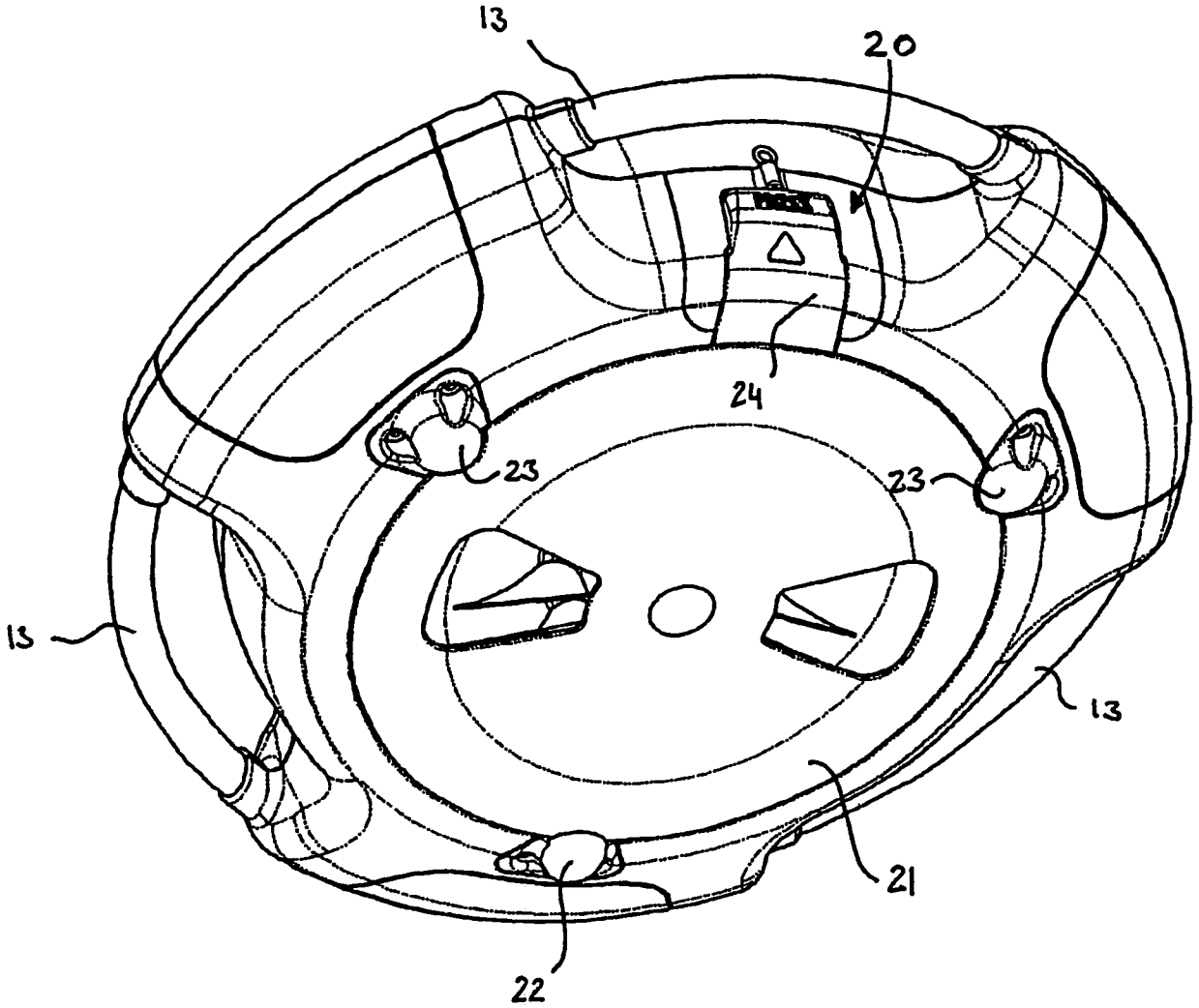
FIG. 7 shows a bottom perspective view of a second embodiment of a sub-aqua breathing system according to the present invention.
Figure 8:
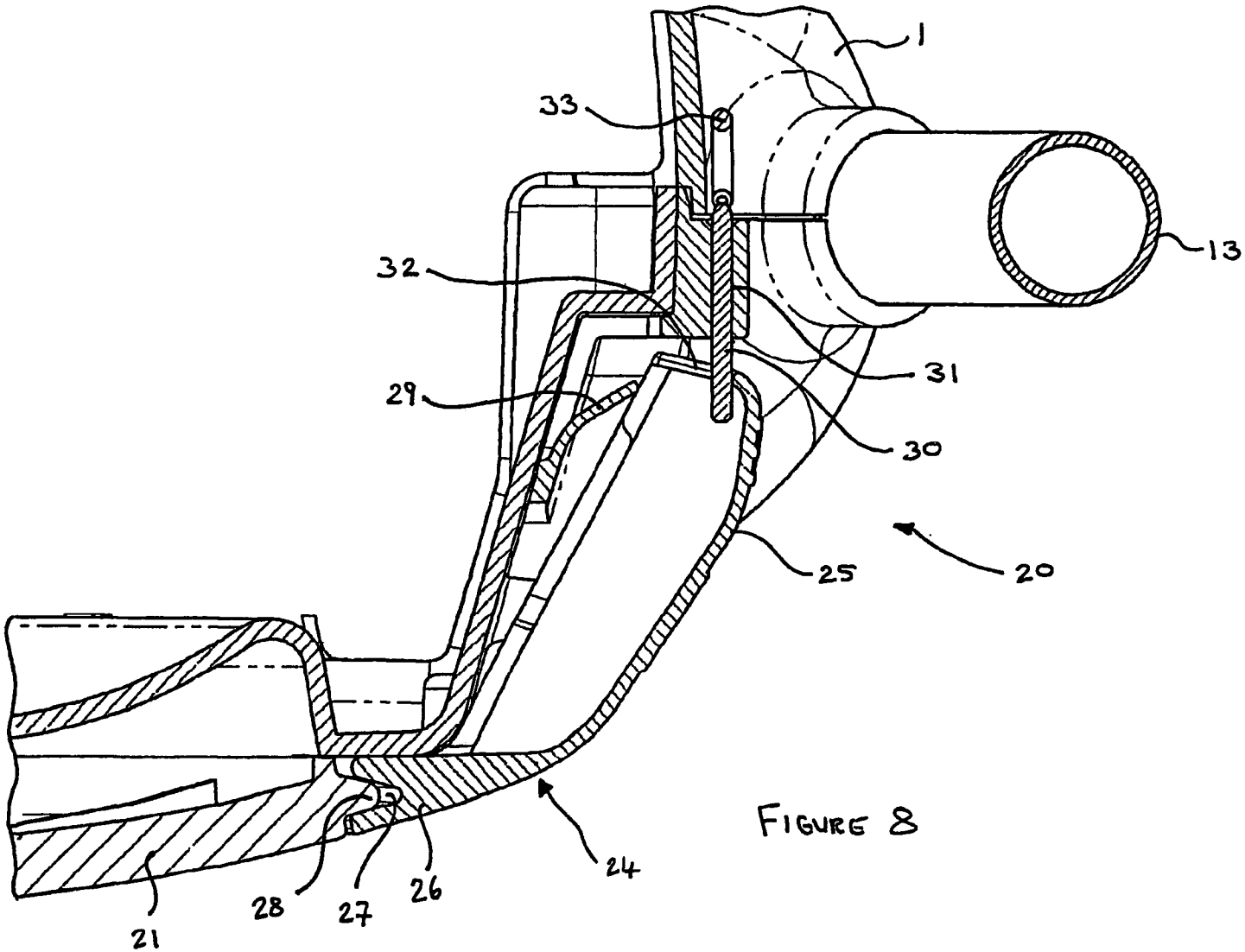
FIG. 8 shows an enlarged partial side sectional view of the release mechanism forming part of the system shown in FIG. 7.

As can be seen from FIG. 7, the rotatable portion 5 is replaced with a releasable base plate 21 beneath which the air line or lines 7 are coiled within the housing 1. The base plate 21 is loosely mounted to the housing beneath a lug 22. Two further lugs 23 can also be seen in the Figures. However, the base plate 21 is cut away in the region of these lugs 23 so that the base plate 21 can drop away past them. The release mechanism 20 is located radially opposite the lug 22. The three lugs 22, 23 together form feet to support the housing 1 on a flat surface. The construction and operation of the release mechanism 20 will now be explained with particular reference to FIG. 8.

The release mechanism 20 comprises a lever 24 pivotally mounted on the housing 1. The lever 24 has a button part 25 extends partially up the side of the housing 1 and a base plate retention part 26 extending beneath the housing 1 and terminating in a groove 27. The base plate 21 is formed with a corresponding protruberance 28 which locates in the groove 27 to retain the base plate 21 mounted to the housing 1. The lever 24 is biased into the rest position shown in Figure by a spring element 29 mounted on the housing 1 and which engages a rear surface of the button part 25. A safety release pin 30 is also provided to prevent inadvertent operation of the release mechanism 20. The pin 30 extends through an aperture 31 in the housing 1 and locates in an opening 32 in an upper region of the button part 25 thereby preventing movement of the lever 24. The upper end of the pin 30 is formed with a loop 33 to which a length of cord (not shown) may be attached to tie the pin to another part of the housing 1 to prevent it from being lost when removed from the aperture 31.

Figure 9:
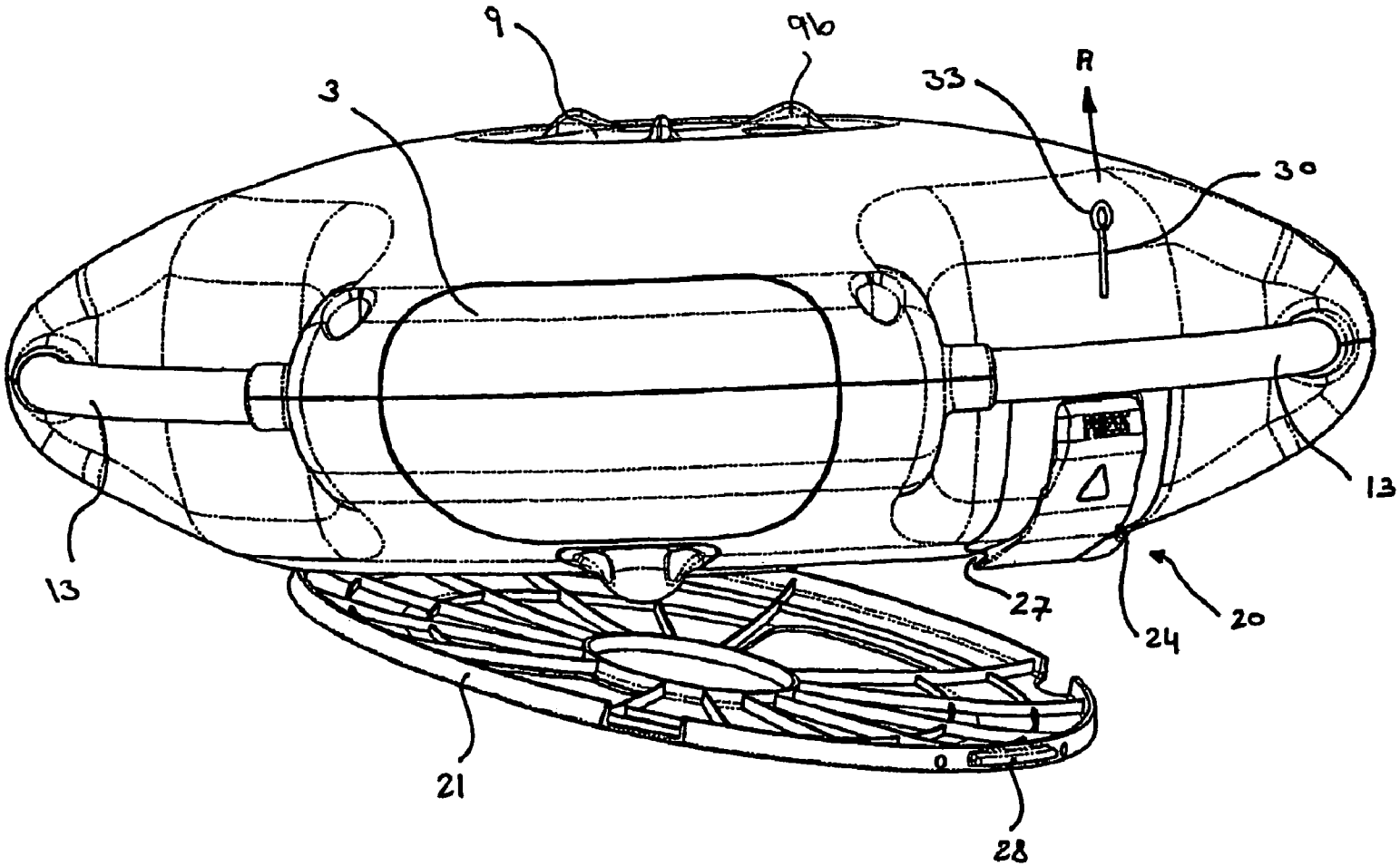
FIG. 9 shows a side view of the system shown in FIG. 7 with the safety pin removed and the base plate falling away from the housing to release one or more air-lines.

When the air line 7 is to be released, the user removes the pin 30 by pulling it from the aperture 31 in the direction indicated by arrow A in FIG. 9. Next, they depress the button part 25 sufficiently hard enough to overcome the bias provided by the spring element 29. This causes the base plate retention part 26 to pivot so that the protruberance 28 is no longer seated in the groove 27. The base plate 21 is now free to drop away from the housing 1, as shown in FIG. 9, thereby releasing the air lines 7 from the storage compartment in the housing 1.

A further cord (not shown) may be provided between the base plate 21 and the housing 1 to prevent loss of the base plate 21 when released from the housing 1.

It will be appreciated from the foregoing that the sub-aqua breathing system of the present invention provides a highly portable, easy to use device. As it floats on the water surface, the diver is unencumbered by a compressed air tank on his back and so has considerably more freedom. The size and weight of the device is also much less than with conventional SCUBA gear.

While particular embodiments of the invention have been described above it will be clear that alternative forms of construction would occur to those skilled in the art, such alternatives are intended to be within the scope of the invention which is defined by the following claims.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A sub-aqua breathing system comprising a housing having a top and a bottom portion configured, in use, to float on the surface of a body of water with said top portion uppermost and said bottom portion at least partially immersed in said body of water, said housing containing buoyant material and a compressed air tank connectable to an air line feeding a mouthpiece regulator, wherein the tank is toroidal and the bottom portion of the housing of the housing includes a storage compartment within it for retaining at least one air line therein and means in the bottom portion of the housing for deploying said at least one air line from said compartment when the system is used.

2. A sub-aqua breathing system according to claim 1 wherein said means is operable to partially deploy said at least one air line from the housing when the system is used.

3. A sub-aqua breathing system according to claim 1, wherein the buoyant material is disposed in regions around the periphery of the toroidal compressed air tank.

4. A sub-aqua breathing system according to claim 1, including a base rotatably mounted to the housing to cover the storage compartment and having at least one opening therein for the passage of an air line from the storage compartment through the base.

5. A sub-aqua breathing system according to claim 1, including a base and a release mechanism for releasably mounting the base to the housing over the storage compartment.

6. A sub-aqua breathing system according to claim 5, wherein the release mechanism is a lever pivotally mounted to the housing, the lever and base including cooperating means that engage to retain the base on the housing.

7. A sub-aqua breathing system according to claim 6, wherein the release mechanism includes spring means to bias the lever into a position in which the cooperating means are in engagement.

8. A sub-aqua breathing system according to claim 6, wherein the release mechanism includes a safety release pin that cooperates with the housing and the lever to prevent inadvertent operation of the release mechanism.

9. A sub-aqua breathing system according to claim 1, including at least one air line coiled within the storage compartment, each air line having one end connected, via an air flow control valve, to the toroidal compressed air tank.

10. A sub-aqua breathing system according to claim 1, wherein a removable cover is mounted on the housing to provide access to the interior thereof.

11. A sub-aqua breathing system according to claim 10 wherein the housing contains a mast with a diving pennant attached thereto, the mast being removable from the housing and mountable in a socket thereon.

12. A sub-aqua breathing system as claimed in claim 1, wherein the buoyant material is formed from a number of circumferentially spaced floats, the system including means for radially deploying the floats from the housing.

13. A sub-aqua breathing system according to claim 12 wherein the deployment means includes an air bag associated with each float and inflatable in response to operation of a manually operated valve to direct air from the compressed air tank to the air bags to radially deploy the air bags from the housing.

14. A sub-aqua breathing system as claimed in claim 13 wherein the floats are attached to spring means operable to retract the floats in response to operation of a second manually operated valve to expel the air from the air bags.

15. A sub-aqua breathing system according to claim 1, wherein the housing has a discus-like shape.

16. A sub-aqua system according to claim 1, wherein a light is mounted on the housing.

17. A sub-aqua system according to claim 1, wherein the housing forms a sealed unit such that air trapped within the housing and surrounding the toroidal tank provides additional buoyancy thereto.

* * * * *